US008798295B2

(12) United States Patent
Menzl et al.

(10) Patent No.: US 8,798,295 B2
(45) Date of Patent: Aug. 5, 2014

(54) METHOD FOR DEPLOYING HEARING INSTRUMENT FITTING SOFTWARE, AND HEARING INSTRUMENT ADAPTED THEREFOR

(75) Inventors: Stefan Daniel Menzl, Jona (CH); Ivo Hasler, Winterthur (CH); Daniel Eisenegger, Stafa (CH)

(73) Assignee: Phonak AG, Stafa (CH)

( * ) Notice: Subject to any disclaimer, the term of this patent is extended or adjusted under 35 U.S.C. 154(b) by 323 days.

(21) Appl. No.: 13/083,818

(22) Filed: Apr. 11, 2011

(65) Prior Publication Data

US 2011/0188682 A1 Aug. 4, 2011

Related U.S. Application Data

(63) Continuation of application No. 10/841,692, filed on May 7, 2004, now Pat. No. 7,945,065.

(51) Int. Cl.
*H04R 25/00* (2006.01)

(52) U.S. Cl.
USPC ..... 381/314; 381/60

(58) Field of Classification Search
CPC ..... H04R 25/50; H04R 25/70; H04R 25/205; H04R 25/502; H04R 25/505; H04R 25/558; H04R 2225/41; H04R 2225/55
USPC ..... 381/60, 312–323; 600/559; 73/585
See application file for complete search history.

(56) References Cited

U.S. PATENT DOCUMENTS

| | | | | |
|---|---|---|---|---|
| 4,989,251 | A | 1/1991 | Mangold | |
| 5,226,086 | A | 7/1993 | Platt | |
| 5,909,497 | A * | 6/1999 | Alexandrescu | 381/312 |
| 5,910,997 | A | 6/1999 | Ishige et al. | |
| 6,058,197 | A * | 5/2000 | Delage | 381/314 |
| 6,175,635 | B1 * | 1/2001 | Meyer et al. | 381/314 |
| 6,229,900 | B1 | 5/2001 | Leenen | |
| 6,590,986 | B1 | 7/2003 | Fazio et al. | |
| 6,724,862 | B1 | 4/2004 | Shaffer et al. | |
| 6,895,345 | B2 | 5/2005 | Bye et al. | |
| 6,978,155 | B2 * | 12/2005 | Berg | 455/557 |
| 7,200,237 | B2 | 4/2007 | Zhang et al. | |
| 7,286,673 | B2 * | 10/2007 | Bindner et al. | 381/60 |
| 7,945,065 | B2 * | 5/2011 | Menzl et al. | 381/314 |

(Continued)

FOREIGN PATENT DOCUMENTS

| | | | |
|---|---|---|---|
| EP | 0794687 | A1 | 9/1997 |
| EP | 1351552 | A2 | 10/2003 |
| EP | 1420611 | A1 | 5/2004 |
| WO | 01/54458 | A2 | 7/2001 |

OTHER PUBLICATIONS

European Search Report for EP 04 40 5290 dated Dec. 21, 2004.

*Primary Examiner* — Xu Mei
(74) *Attorney, Agent, or Firm* — Pearne & Gordon LLP

(57) ABSTRACT

A method for deploying hearing instrument fitting software wherein the fitting software comprises executable fitting program code (13) configured to process fitting program data (12,14) on a programmable data processor (11), comprises the steps of reading fitting program definition data (3) from data storage means provided in the hearing instrument (1), determining, from the fitting program definition data (3), at least part of least one of the fitting program data (12,14) and the fitting program code (13).

The hearing instrument itself comprises the information defining the fitting software—be it the complete fitting software or an update or change to a fitting software residing in an external device.

6 Claims, 3 Drawing Sheets

(56) References Cited

U.S. PATENT DOCUMENTS

2001/0033664 A1 10/2001 Poux et al.
2002/0054689 A1 5/2002 Zhang et al.
2002/0191800 A1 12/2002 Armstrong
2003/0133578 A1 7/2003 Durant
2004/0190738 A1 9/2004 Meier et al.

* cited by examiner

METHOD FOR DEPLOYING HEARING INSTRUMENT FITTING SOFTWARE, AND HEARING INSTRUMENT ADAPTED THEREFOR

FIELD OF THE INVENTION

The invention relates to the field of hearing instrument systems. It relates to a method for deploying hearing instrument fitting software, and to a hearing instrument and an interface device adapted therefor.

BACKGROUND OF THE INVENTION

The term "hearing instrument" or "hearing device", as understood here, denotes on the one hand hearing aid devices that are therapeutic devices improving the hearing ability of individuals, primarily according to diagnostic results. Such hearing aid devices may be Behind-The-Ear hearing aid devices or In-The-Ear hearing aid devices. On the other hand, the term stands for devices which may improve the hearing of individuals with normal hearing e.g. in specific acoustical situations as in a very noisy environment or in concert halls, or which may even be used in context with remote communication or with audio listening, for instance as provided by headphones.

The hearing devices as addressed by the present invention are so-called active hearing devices which comprise at the input side at least one acoustical to electrical converter, such as a microphone, at the output side at least one electrical to mechanical converter, such as a loudspeaker, and which further comprise a signal processing unit for processing signals according to the output signals of the acoustical to electrical converter and for generating output signals to the electrical input of the electrical to mechanical output converter. In general, the signal processing circuit may be an analog, digital or hybrid analog-digital circuit, and may be implemented with discrete electronic components, integrated circuits, or a combination of both.

The term "fitting" denotes the process of determining at least one audiological parameter from at least one aural response obtained from a user of the hearing instrument, and programming or configuring the hearing instrument in accordance with or based on said audiological parameter. In this manner, parameters influencing the audio and audiological performance of the hearing instrument are adjusted and thereby tailored or fitted to the end user. For hearing instruments using software controlled analogue or digital data processing means, the fitting process determines and/or adjusts program parameters embodied in said software, be it in the form of program code instructions, algorithmic parameters or in the form of data processed by the program.

WO 01/54458 A2 discloses a communication system linking e.g. a hearing instrument to a programming device and further, via a mobile device such as a cellular phone, to a communications network such as the internet, and to a server computer. The communication system is used to provide instructions and program code to update the hearing instrument software or its parameters. For example, an aural response is determined by executing a program downloaded from the server to the mobile device, then response data is uploaded from the mobile device to the server. A fitting program executing on the server determines program or parameter updates which then are sent, via the mobile device and optionally through the programming device, to the hearing instrument. In one embodiment, the mobile device comprises all the software needed for fitting, so it must not be downloaded from the server or executed on the server. However, in this as in all the other embodiments presented, any use of updated fitting software requires a connection to the server via the communication system.

US 2002054689 shows the downloading of hearing device software from a network to a local client and then storing the software in the hearing device.

Despite the general enthusiasm for interconnecting all kinds of electronic devices, the fact remains that a large percentage of hearing instrument users and also audiologists do not have access to a communications network such as the internet today. As long as this situation persists, deploying fitting software, that is, distributing and applying modified fitting software remains cumbersome and will have to involve shipment of some kind of data medium.

One consequence of this state of affairs is that different versions or releases of the fitting software and of the hearing aid software, with which the fitting software interacts, must be carefully synchronised. When hearing instruments with modified internal software leave the factory, the fitting software in use by several thousands of audiologists must be updated. This severely hampers the flexibility and the distribution of new software releases, both in hearing instruments and of fitting software.

EP 0 794 687 A1 discloses a method for determining a transmission characteristic of a hearing instrument. According to this method, a program to be executed by a hearing instrument processor is generated by an external device. This generation process is based, among others, on hardware parameters describing the physical setup of the hearing device, which hardware parameters are stored in the hearing instrument and transmitted to the external device together with data characterizing hearing situations encountered and recorded during the use of the hearing instrument. The fitting software running on the external device must be programmed to recognize the predetermined possible hardware configurations and to generate a new software that works on said hardware configuration.

The abovementioned problem of how to distribute new fitting software that is adapted to the features of new hearing instrument software remains.

DESCRIPTION OF THE INVENTION

It is therefore an object of the invention to create a method for deploying hearing instrument fitting software, and a hearing instrument and an interface device adapted therefor of the type mentioned initially, which overcomes the disadvantages mentioned above.

These objects are achieved by a method for deploying hearing instrument fitting software, and a hearing instrument and an interface device adapted therefor.

The method for deploying hearing instrument fitting software, wherein the fitting software comprises executable fitting program code configured to process fitting program data on a programmable data processor, comprises the steps of

- reading fitting program definition data from data storage means provided in the hearing instrument,
- determining, from the fitting program definition data, at least part of least one of the fitting program data and the fitting program code.

The hearing instrument is adapted to the deployment of fitting software, wherein the fitting software comprises executable fitting program code configured to process fitting program data on a programmable data processor. The hearing instrument comprises data storage means on which is stored fitting program definition data that specifies at least part of least one of the fitting program data and the fitting program code.

Thus, the hearing instrument itself comprises the information defining the fitting software—be it the complete fitting software or an update or change to a fitting software residing in an external device, such as a programming device, a personal computer, digital assistant or the like.

When the hearing instrument software is modified, a new software release is incorporated in hearing instruments being manufactured and distributed. Corresponding modifications are made to the fitting program definition data which comprises at least one of meta-data, fitting program code and fitting program data, and which is distributed together with the new hearing instrument software, stored in the hearing instrument. In this manner, the fitting software can be automatically modified to correspond precisely to the hearing instrument's software, and preferably no additional communication or software distribution channels are required.

In a preferred embodiment of the invention, the fitting program definition data defines fitting program code that is executable on a data processing device. In this manner, a complete fitting software can be distributed from within the memory of the hearing device.

In a preferred variant of this embodiment, the fitting program code is executable by a data processing device arranged in the hearing instrument itself. In order to interact with the user, the hearing instrument may communicate with an external device or may make use of interface means provided as part of the hearing instrument itself.

In the latter case, when the fitting software communicates with the user by means of the interface means of the hearing instrument itself, no external device is required. In this case, for example,

- user input is acquired by having the user operate an existing hearing instrument button a certain number of times, or
- user input is acquired by using audio input signals, generated by the user or with an additional device (e.g. mobile phone, a dual-tone audio signal generator, a mechanical device for generating clicks, etc. . . . ) operated by a user, or
- user input is acquired by using the means of the remote control, or
- user input is acquired by the user manipulating an analog input wheel otherwise used for loudness control, and
- feedback to the user is done by the having the hearing instrument generate signal tones.

The fitting process is, for example guided by written instructions and/or by audio instructions distributed e.g. on an audio compact disc, DVD, VHS tape or booklet. In an exemplary adjustment step, the instructions may ask the user to press a button on the hearing instrument a certain number of times, then to say "hello" and then to press the button once, if the sound was perceived to be too weak, and twice, if it was perceived to be comfortable. In such a manner, perhaps with more measurement and feedback steps, a basic adjustment of the hearing instrument can be performed without any further device means, fitting it to the user's hearing capabilities. The same principle may also be applied for self-guided fine adjustments. This process may include signals from the CD or DVD, self-calibration of the environment using the hearing instrument and/or sound from additional external devices.

In a further preferred embodiment of the invention, an external device is arranged to communicate with the hearing instrument, be it by wireless or wired means. A simple version of the external device comprises at least one analog and/or at least one digital input means. Thus, the external device may be a simple box with one or more potentiometers and switches. The states of these input devices may be determined by an analog to digital converter (ADC) in the hearing instrument itself, or the box may comprise ADCs and communication circuits for communicating with the hearing instrument by means of known digital communication protocols such as RS-232, I2C, etc. In order to provide feedback to the user, the audio output of the hearing instrument and/or display means such as light emitting diodes or an alphanumeric display arranged on the box.

Thus, such an interface device is configured to be used as an external device interoperable with a hearing instrument according to the invention. The interface device comprises at least one of an analog input, a digital input, an analog output or a digital output, and further comprising means for communicating at least one signal that is representative of corresponding input and output values to or from the hearing instrument, respectively.

In a further preferred embodiment of the invention, the external device is a handheld or mobile device such as a personal digital assistant, a mobile phone, a laptop computer etc. The hearing instrument communicates with the external device by means of one of the communication links mentioned above, or by wireless means such as Bluetooth or other protocols. Depending on the nature and processing power of the external device and of overall optimisation criteria, the tasks and the computational load of the fitting software are distributed according to one of the following preferred embodiments:

- The external device provides a text based terminal function accepting text strings from the hearing instrument and returning text strings.
- The external device comprises a web browser for displaying and returning information provided according to the HTML (hypertext markup language) or a related protocol.
- The external device displays graphical information encoded in an appropriate graphic description language received from the hearing instrument device. All interaction with the user of the box is controlled by the language elements provided by the hearing device. The fitting process itself is controlled by the processor in the hearing instrument.

In the above three cases, the fitting program definition data corresponds to the code of the fitting program being executed in the hearing instrument. In the following preferred variant of the invention, the fitting program definition data comprises fitting program code that is executable and executed on a data processing device arranged in the external device: Fitting program definition data is loaded from the hearing instrument into the external device and executed therein, with

- the fitting program code comprising user interface software, or
- the fitting program interacting with standard user interface software such as a browser, already residing in the external device.

The functionality of the fitting software may be also distributed among the hearing instrument and the external device. For example, the external device may also or alternatively comprise means for executing program components based on the paradigm of client based computing. Such components may be implemented as JAVA applets or ActiveX components or the like that are provided by the hearing instrument. Components or instructions may also be transmitted to the external device and be executed on the external device on demand, i.e. piecewise. The term "processor code" comprises both processor specific code as well as target processor independent intermediate code, such as so-called bytecode or intermediate language which is locally translated into processor code. In both cases, the fitting program definition data may be stored in the hearing instrument in compressed form, and be decompressed in the hearing instrument itself or in the external device.

In a related set of further preferred embodiments of the invention, the fitting program definition data defines code or data that is loaded into the external device and that replaces, complements or defines program data and/or program code of the fitting software that is already resident in the external device and/or has been or can be transferred to the external device by other means.

In this manner, the resident software is updated or configured exactly according to the software version running on the hearing instrument.

This update or configuration may be accomplished according to one or more of different preferred procedures:

- The fitting program definition data comprises fitting program code representing a software module that replaces an existing software module of the external device's software. For example, such a module may be a Java class or a program module according to the .net system.
- The fitting program definition data comprises a section of fitting program code that is linkable to one or multiple predetermined program locations or "program hooks" of the existing software in the external device.
- The fitting program definition data comprises fitting program data that replaces or augments data residing in the external device.
- The fitting program definition data comprises meta-data that defines the current or actual structure and parameters of flexibly configurable software residing on the hearing instrument. In this manner, a structural change and other changes in the hearing instrument software can be accounted for by the fitting software residing in the external device.
- The fitting program definition data comprises program code and data that represents complete fitting software, and is transferred to and executable on the external device.
- The fitting program definition data comprises a definition of a network location (e.g. an IP address or URL) from which, in the case that a communication network connection is available to the external device, further fitting program definition data is downloaded to the external device. The further fitting program definition data can be of one of the same types as the fitting program definition data described herein, and be used in the same manner.
- Preferably, the fitting program definition data defining the network location, after being loaded from the hearing instrument to the external device, comprises code that is executed thereon and initiates a network connection to a server providing the further fitting program definition data, and causes said further fitting program definition data to be downloaded to and installed in the external device.

Whichever the manner in which the software resident in the external device is updated or configured, the software change may

- be volatile and revert back to its previous state after the fitting process, or
- be persistent and be maintained in the updated version, or
- cause the separate storage of the update or configuration information. Several sets of such information may be stored. Each of them is associated with a specific hearing instrument device, device type or series identification code, which is provided by the hearing instrument. In this manner, if a device or type of device is encountered whose fitting program definition data has already been transferred to the external device in an earlier fitting session, then no new transfer is required, and the fitting software is (temporarily) updated or configured according to the stored fitting program definition data from the earlier session.

Furthermore, regardless of the exact nature of the fitting program definition data, it may be stored in the hearing instrument and optionally also transferred to the external device in compressed form. The term "fitting program definition data" therefore, depending on the context, refers to the uncompressed or the compressed representation. The compression scheme may take one of the following preferred forms:

- The fitting program definition data comprises a definition of specific data or program code items along with replacement items. Said items may be single bytes, larger chunks of code, subroutines or entire program components. A replacement item may also comprise instructions that cause the original item to be deactivated. The update of the software comprises the step of combining the fitting program definition data with data residing in the external device by replacing one or more data items such as bytes, lines etc. of data residing in the external device at locations specified by corresponding data items contained in the fitting program definition data.
- The fitting program data may be compressed according to a known, commonly used data compression scheme.
- The fitting program definition data may be compressed with such a compression scheme, but based on references to the code and/or data already residing in the external device. As an example, the commonly used ZIP compression scheme normally builds a dictionary of commonly used data strings, along with a list of codes that define how to assemble these data strings in order to reconstruct the uncompressed data. The same can be done by using a dictionary that is generated from the "old" program residing in the external device (and which is known to the hearing instrument at the time it is produced and deployed), and by storing only the list of codes for the "new" program in the hearing instrument. Since the "old" and "new" programs are to a large extent similar, this is very efficient.

Further preferred embodiments are evident from the dependent patent claims.

BRIEF DESCRIPTION OF THE DRAWINGS

The subject matter of the invention will be explained in more detail in the following text with reference to preferred exemplary embodiments which are illustrated in the attached drawings, in which.

Figure 1:
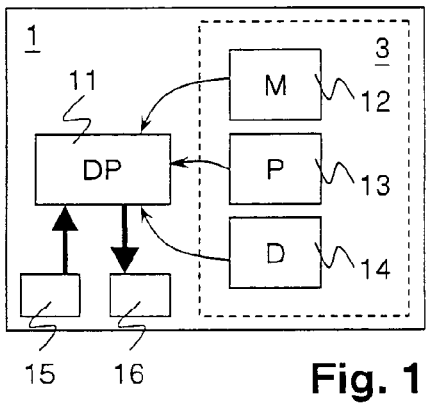
FIGS. 1 through 6 schematically show a conceptual structure of a hearing instrument and optionally an external device, and associated information flows, according to different preferred embodiments of the invention.

The reference symbols used in the drawings, and their meanings, are listed in summary form in the list of reference symbols. In principle, identical parts are provided with the same reference symbols in the figures. Data transfer operations are represented by thin arrows, and (physical) communication connections are represented by thick arrows.

DETAILED DESCRIPTION OF PREFERRED EMBODIMENTS

FIG. 1 schematically shows a first preferred embodiment of the invention. A hearing instrument 1 comprises a hearing instrument data processing device or hearing instrument processor 11 and storage means storing fitting program definition data 3. The fitting program definition data 3 comprises at least one of meta-data 12, fitting program code 13 and fitting program data 14. The hearing instrument processor 11 is configured to execute the fitting program code 13. Execution of the code is optionally controlled according to the meta-data 12 and uses and/or modifies the fitting program data 14. The hearing instrument processor 11 is arranged to accept input data from a hearing instrument input device 15 such as at least one push button or switch, and/or one or more analog input devices such as control wheels or sliders. The hearing instrument 1 also comprises hearing instrument software, (not shown) that is, program code that implements the actual audio data processing function of the hearing instrument 1 and that is configured and/or parameterised by the fitting process.

When the hearing instrument processor 11 executes the fitting program code 13, user interaction is accomplished by means of the hearing instrument input device 15 and the hearing instrument output device 16.

Figure 2:
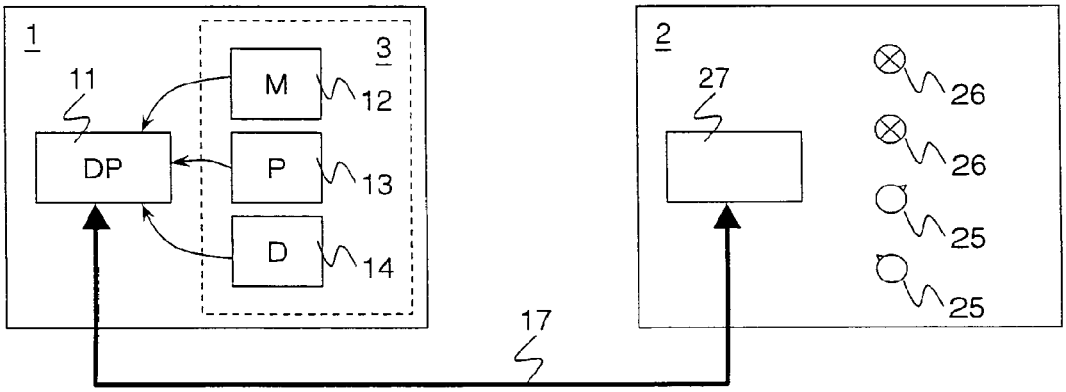

FIG. 2 schematically shows a second preferred embodiment of the invention. Here, as in the following preferred embodiments of the invention, mainly the features of the respective embodiment are shown and explained. However, the other features not shown in the respective figures or mentioned in the description may be present as well.

In addition to the hearing instrument 1, an external device 2 is present, which in this case is a simple box with insignificant data processing means, and comprising one or more external device input devices 25 and optionally one or more external device output devices 26, and interface means 27 to the communication link 17. An external device input device 25 is e.g. a potentiometer, a latching or non-latching pushbutton or a toggle switch. An external device output device 26 is e.g. a light emitting diode or an alphanumeric liquid crystal display. The hearing instrument 1 and the external device 2 are arranged to communicate through a communication link 17. If the external device 2 comprises one or more analog potentiometers, their values can be determined by an analog to digital converter (ADC) located in the hearing instrument. The interface means 27 then preferably comprises a multiplexer arranged for sequentially connecting the potentiometers to a line of the communication link 17. Alternatively, the interface means 27 comprises ADC conversion means and a communication interface for exchanging data with the hearing instrument 1 according to a predetermined communication protocol. Alternatively, the resistor values for the potentiometers are spread by proper selection of the potentiometer and/or additional resistors so that the state of multiple potentiometers can be read out using one single ADC.

The communication with the user is accomplished in a similar manner as with the first embodiment. However, the input means are more comfortable and easier to operate.

Figure 7:
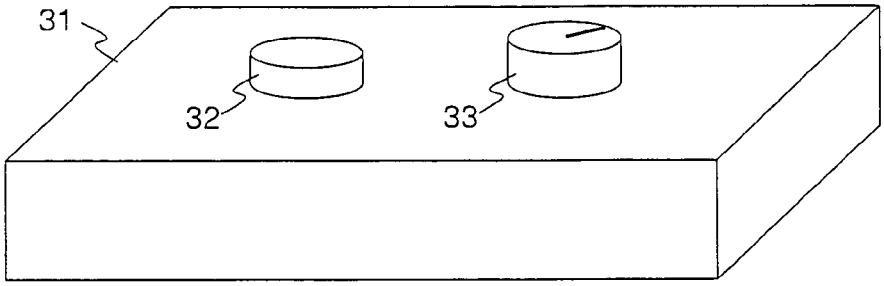
FIG. 7 schematically shows a simple version of an external device.
Figure 8:
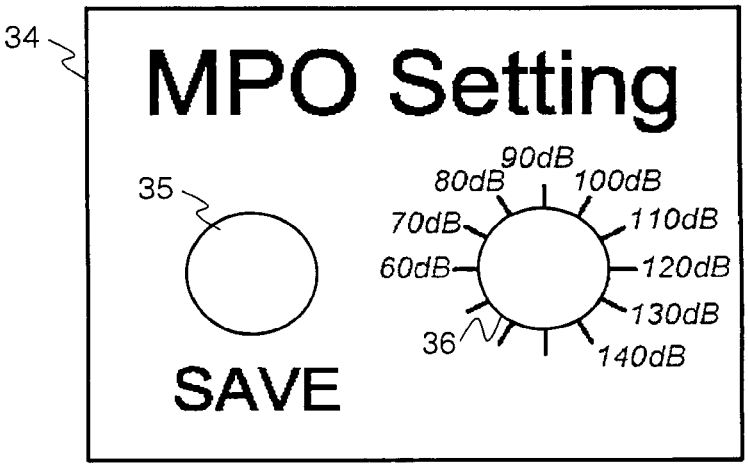
FIGS. 8 and 9 show exemplary covers to be used together with said external device.
Figure 9:
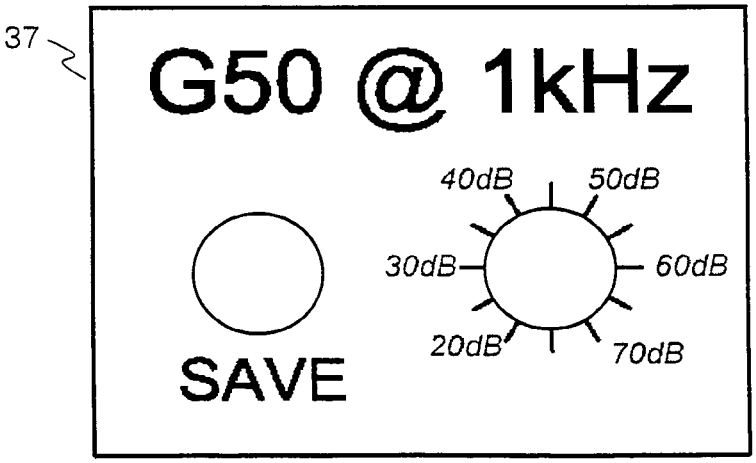

FIG. 7 shows a preferred embodiment of the invention in which the external device 2 is a box 31 comprising a non-latching pushbutton 32 and a potentiometer 33. These serve as digital and analog input devices respectively that are configured to provide input signals readable by the hearing instrument 1. A set of covers or overlays 34, 37 is provided, as shown in FIG. 8 and FIG. 9. The covers 34, 37 are shaped with openings or holes 35, 36 such that they can be placed over a box surface with the openings 35, 36 fitting over the pushbutton 32 and the potentiometer knob 33. In this manner, the input elements 32, 33 can have different meanings in different steps of the fitting process. As an example, the box has one button 32 that is usually labelled SAVE. The said cover will then be replaced every time the user has pressed said SAVE button 32. In a first step, for example, the maximum output power (MPO) is fitted, with the first cover 34 being in place: The user turns the knob 33 to a position according to the engravings of the first cover. Then, he presses SAVE, replaces the first cover 34 by the second cover 37 and continues with step two. In this step, the gain is configured using the same potentiometer 33. The second cover 37 for step two shows the possible gain values. In another embodiment of the invention, the covers are also configured to indicate a label and/or a scale for an output device 26.

Figure 3:
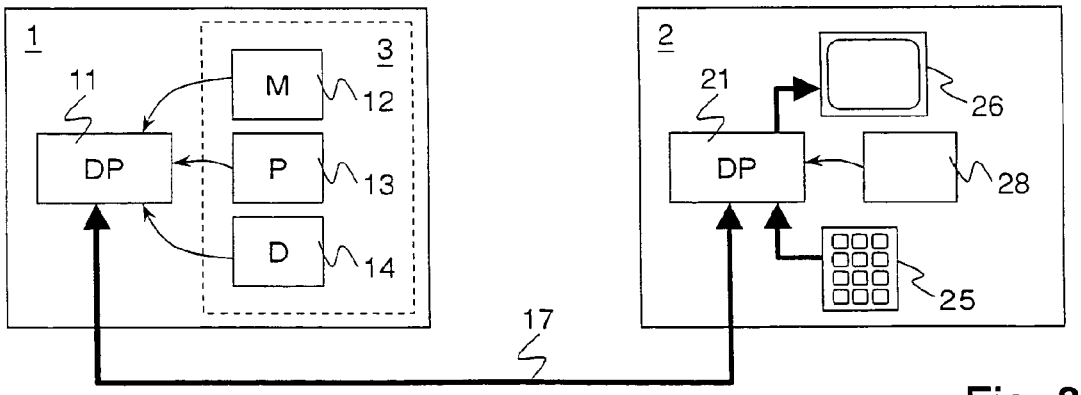

FIG. 3 schematically shows a third preferred embodiment of the invention. The external device 2 here comprises its own data processing device 21, and program storage means storing, among others, browser or terminal emulator software 28. Thus, the external device 2 may be a handheld mobile or a stationary computing device such as a personal digital assistant (PDA), cell phone, laptop or desktop computer etc., or a device dedicated to hearing instrument applications. In this embodiment, the external device input device 25 typically is a keyboard or keypad or touch screen, and the external device output device 26 typically is an alphanumeric or graphics capable screen.

Again, the principles of interaction with the user are similar as in the preceding preferred embodiments, but with increased flexibility and versatility of the user interface. In particular, instructions guiding the user or an audiologist through the fitting process may be displayed on the external device output device 26.

Figure 4:
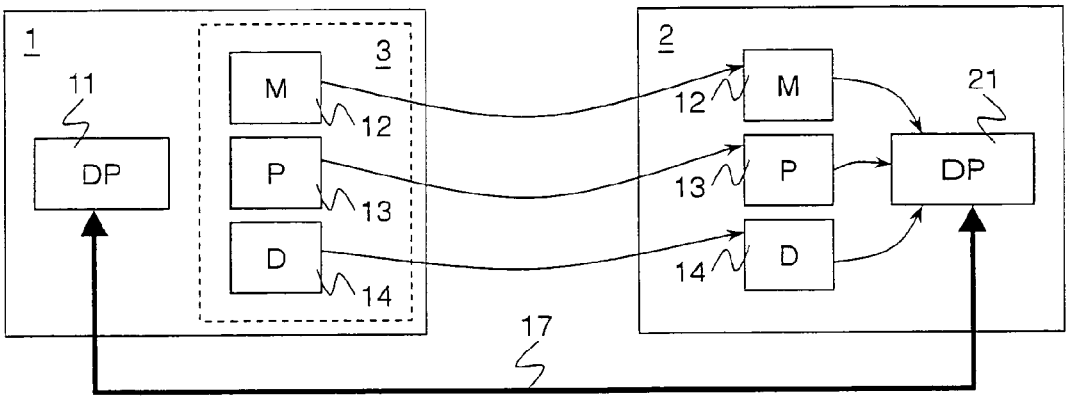

FIG. 4 schematically shows a fourth preferred embodiment of the invention. Here, at least one of the meta-data 12, the fitting program code 13, and the fitting program data 14 is transferred by means of the communication link 17 to a storage location in the external device 2. The different types of code or data are stored as fitting program definition data 3 in the hearing instrument, in plain or in compressed form, and may be decompressed by the hearing instrument processor 11 or by the external device processor 21. The different types of code or data comprise information that specifies how and where to combine it with program code or data that is already resident in the external device 2.

For example, a complete fitting software can be transferred from the hearing instrument 1 to the external device 2. In another example, in which fitting program definition data 3 is combined with code or data that is already resident in the external device 2: The maximum output power (MPO) is displayed on the screen, but the value is received as metadata from the hearing instrument 1. Another example is, that the memory 3 of the hearing instrument 1 stores program code 13 for the fitting process of a specific hearing instrument feature, such as a specific feedback canceller. The code is transferred to the external device 2 and executed by the processor 21. The code then generates an additional graphical user interface control element such as a control slider for the new parameter. As a result, the control has been introduced for this particular hearing instrument only.

Figure 5:
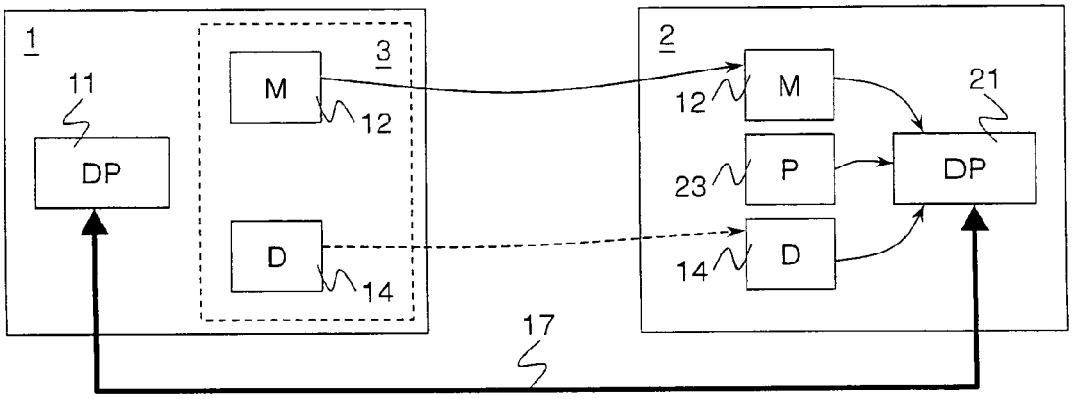

FIG. 5 schematically shows a fifth preferred embodiment of the invention. Only meta-data 12 is transferred from the hearing instrument 1 to the external device 2. The use of meta-data 12 is based on the fact that the hearing instrument software is modularised, structured and parameterised, and that this is done in a fashion that different versions of the software, differing in structure and parameters, can be represented by a set of so-called meta-data items. Having the hearing instrument software structured in this manner allows to manufacture different types of hearing instruments and their associated software to a large extent in the same manner up to a late production stage. Individual model types are then created by configuring the hardware and the software, or even only the software, in accordance with the structural flexibility inherent in the software, by setting values of meta-data parameters.

For example, meta-data items represent information such as

- feedback canceller software available or not
- noise canceller software available or not
- maximum output power
- maximum and minimum gain for each of a set of frequency ranges
- filter parameters
- configuration parameters for the gain model, such as time constants and gain at 50 dB Sound Pressure Level (SPL) input. This value is also known as "G50".

The fitting software 23 that is already resident in the external device 2 is configured to accept and properly process the meta-data description of the large variety of hearing instruments corresponding to the variability of the different meta-data items. The working of the fitting software and its interaction with the user or audiologist is adapted according to the meta-data. Thus, the meta-data 12 may be considered as a special type of fitting program data 14 that controls execution of the fitting software. For example, if the meta-data 12 shows that a noise canceller software module or functionality is present in the hearing instrument, then the fitting software

- displays, e.g. in a graphic user interface, parameters of the noise canceller function and allow them to be modified, and
- incorporates the fact that a noise canceller is present into the computation of response diagrams presented to the user, and into the computation of parameters of other software components, such as filters, and/or
- displays, e.g. in a graphic user interface or in a appropriate fitting process flow the controls for the parameters. The number of filter bands may be a parameter defined by the meta data and may vary from device to device. The fitting software 23 is therefore made in a way that it processes the metadata 12 and displays only the appropriate number of controls, and/or
- behaves differently with respect to feature selection: Depending on the nature of the device, the number of available limiters may vary and the fitting software 23 will only display and allow selections among the features available for this particular device.

Figure 6:
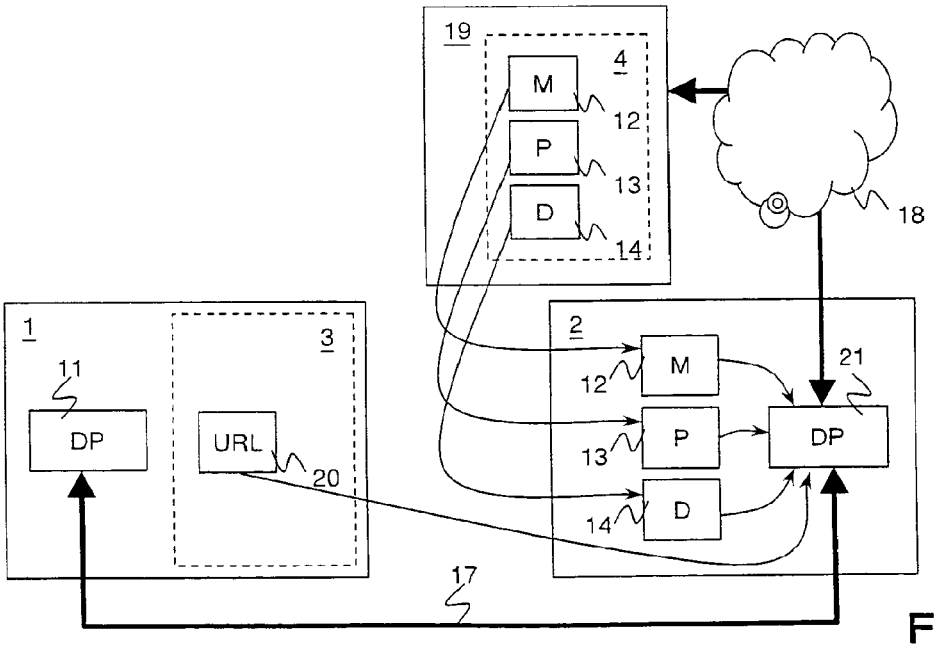

FIG. 6 schematically shows a sixth preferred embodiment of the invention. In this embodiment, the external device 2 comprises a communication link via a computer network 18 such as the internet to a server 19. In the hearing instrument 1, the fitting program definition data 3 comprises a network location specification such as an URL (uniform resource locator) 20. This URL 20 specifies the location of at least one of meta-data 12, fitting program code 13 and fitting program data 14 to be downloaded from the server 19 to the external device 2. The downloaded information of these different types is in a form as essentially described in the above and is processed in the external device 2 in a like manner.

As an example, the embedded software of the hearing instrument 1 is of a later version as the software 13 in the fitting device 2. The hearing instrument now transfers a piece of code or metadata 20 to the external device 2, causing the external device 2 to request some kind of update from a third device or server 19, using the internet or a dial up connection (18)

In all the preferred embodiments of the invention described so far, the storage means arranged in the hearing instrument is a non-volatile memory. Suitable memory technologies currently available are e.g. FLASH memories, E2PROM memories, EPROM memories, fusable link memories, PROM memories ROM memories and powered RAM memories Current hearing devices already provide for a non-volatile memory capacity of e.g. 64 kBytes to begin with. For embodiments requiring a larger capacity, a correspondingly larger memory is provided.

While the invention has been described in present preferred embodiments of the invention, it is distinctly understood that the invention is not limited thereto, but may be otherwise variously embodied and practised within the scope of the claims.

LIST OF DESIGNATIONS

1 hearing instrument
2 external device
3 fitting program definition data
4 further fitting program definition data
11 hearing instrument data processor (DP)
12 meta-data (M)
13 fitting program code (P)
14 fitting program data (D)
15 hearing instrument input device
16 hearing instrument output device
17 communication link
18 computer network
19 server
20 network location specification, URL
21 external device data processor (DP)
23 resident external device program
25 external device input device
26 external device output device
27 interface means
28 browser or terminal software
31 box
32 pushbutton
33 potentiometer
34 first cover
35, 36 holes
37 second cover

What is claimed is:

1. A method for deploying hearing instrument fitting software wherein the fitting software comprises executable fitting program code configured to process fitting program data on a programmable data processing device, wherein the method comprises the steps of:

- reading fitting program definition data from data storage means provided in the hearing instrument, wherein the fitting program definition data comprises executable fitting program code that is executable on a data processing device when fitting the hearing instrument,
- determining, from the fitting program definition data, at least part of the executable fitting program code,
- transferring the executable fitting program code to a storage location in an external device for fitting the hearing instrument, and
- fitting the hearing instrument, by the external device, by executing the fitting program code, received from the hearing instrument, on a data processing device arranged in the external device.

2. A method for deploying hearing instrument fitting software wherein the fitting software comprises executable fitting program code configured to process fitting program data on a programmable data processor, wherein the method comprises the steps of:

reading fitting program definition data from data storage means provided in the hearing instrument, wherein the fitting program definition data represents executable fitting program code that is loadable into an external device which is external to the hearing instrument and that defines changes to fitting software that is already resident in the external device, wherein the external device fits the hearing instrument by executing the executable fitting program code of the fitting software, determining, from the fitting program definition data, at least part of the executable fitting program code, and modifying the fitting software that is already resident in the external device that is external to the hearing instrument in accordance with the fitting program definition data, fitting the hearing instrument by the external device, by executing, on a data processing device arranged in the external device, the executable fitting program code including the at least part of the executable fitting program code modified in accordance with fitting program definition data received from the hearing instrument.

3. The method according to claim 2, wherein the step of modifying the fitting software that is already resident in the external device comprises the step of replacing an existing software module of the external device's software by a software module contained in the fitting program definition data.

4. The method according to claim 2, wherein the step of modifying the fitting software that is already resident in the external device comprises the step of inserting a section of software code contained in the fitting program definition data at a predetermined program location in said fitting software.

5. The method according to claim 2, wherein the step of modifying the fitting software that is already resident in the external device comprises at least one of the steps of replacing data or augmenting data contained in said fitting software by data contained in the fitting program definition data.

6. The method according to claim 2, wherein the step of modifying the fitting software that is already resident in the external device comprises the step of configuring said fitting software in accordance with meta-data contained in the fitting program definition data, wherein said meta-data defines at least part of a structure and parameters of hearing instrument software residing in the hearing instrument.

* * * * *